US005766427A

United States Patent [19]

Mergel et al.

[11] Patent Number: 5,766,427

[45] Date of Patent: Jun. 16, 1998

[54] ELECTROLYZER WITH REDUCED PARASITIC CURRENTS

[75] Inventors: Jürgen Mergel; Hans-Günter Groehn, both of Jülich; Wolfgang Westerhausen, Aldenhoven-Siersdorf, all of Germany

[73] Assignee: Forschungszentrum Julich GmbH, Julich, Germany

[21] Appl. No.: 806,455

[22] Filed: Feb. 26, 1997

[30] Foreign Application Priority Data

Feb. 27, 1996 [DE] Germany ..... 196 07 235.2

[51] Int. Cl.[6] ..... C25B 9/00; C25B 15/08

[52] U.S. Cl. ..... 204/228; 204/256; 204/258; 204/266; 204/279

[58] Field of Search ..... 204/228, 257–258, 204/263–266, 279, 256

[56] References Cited

U.S. PATENT DOCUMENTS

| | | | |
|---|---|---|---|
| 4,196,069 | 4/1980 | Mose et al. | 204/257 |
| 4,415,424 | 11/1983 | Pere | 204/269 X |
| 4,465,579 | 8/1984 | Mataga et al. | 204/257 X |
| 4,713,160 | 12/1987 | Moreland | 204/257 X |
| 4,718,997 | 1/1988 | Grimes et al. | 204/228 |
| 5,296,121 | 3/1994 | Beaver et al. | 204/257 X |

*Primary Examiner*—Donald R. Valentine

*Attorney, Agent, or Firm*—Herbert Dubno

[57] ABSTRACT

An electrolyzer has a metal fitting for supply or discharge or electricity or discharge of gas produced in the electrolyzer and into which, from the passage forming system within the electrolyzer has an electrically insulating tube extending into the metal fitting and hermetically sealed with respect to it, at the end electrode through which the electrically insulating tube passes, or the passage system so that parasitic currents are led along this schematically insulating tube for a length sufficient to render the parasitic losses significant.

14 Claims, 3 Drawing Sheets

ELECTROLYZER WITH REDUCED PARASITIC CURRENTS

FIELD OF THE INVENTION

The present invention relates to an electrolyzer and, particularly, to an electrolyzer of the type sold by Lurgi or Alyzer. Such electrolyzers may be of the Alyzer types 0400 and 0100 or the pressure electrolyzer of Lurgi.

More particularly this invention relates to improvements in electrolyzer constructions so as to reduce parasitic electrical currents particularly at metal fittings connected with the electrolyzer block.

BACKGROUND OF THE INVENTION

Such commercial bipolar electrolyzers generally comprise a multiplicity of cells connected in succession and each of which has a cathode, a diaphragm or membrane and an anode. The assembly of electrolyzer cells forms an electrolysis block, pile or stack. An electrolyte is fed through one or more passages to the cells of the stack or block and one or more passages conduct the gases generated from the cells at the electrodes out of the system. Such passages branch from tubular fittings which are feed pipes in the case of the electrolyte or discharge pipes in the case of the gases evolved.

Through the feed pipes, the electrolyte, usually in the form of aqueous KOH, can be supplied to the individual cells.

The cathodes and anodes are connected to a power supply and, during operation, current flows from one electrode of the cell through the diaphragm to the counterelectrode, the current carriers being ions of corresponding electrical charge. The current flow between the electrodes gives rise to the desired electrolytic decomposition of the electrolyte into hydrogen and oxygen and these gases are separately collected via the discharge passages and are led via the outlet fittings from the electrolysis block or stack.

As a rule, within the cell where these passages are inaccessible, the passages are formed in bodies of electrically nonconductive material. The same applies to the feed and discharge fittings where they also are inaccessible and are within the electrolysis block. These portions of the passages are not, as a rule, grounded since they are not composed themselves of metallic parts and cannot be readily connected to ground because of their inaccessible locations in any event.

However, the fittings for the electrolyte, the hydrogen and the oxygen must be connected to external processing systems and generally pass through the metallic end plates of the electrolysis blocks which can be electrodes of one or the other polarity and may be tied, usually externally of the electrolysis block to, for example, gas separators or cleaning devices, filters, electrolyte recirculating pumps or the like.

Since these peripheral devices usually are comprised of metal or have passages connected to the fittings which are of metal and the fittings themselves are customarily of metal, it is common practice to ground these metal parts for safety reasons.

In the case of a direct current supply, the end cathode at cathodic potential may also be the ground potential and hence these fittings, being electrically grounded, may be connected to this cathode potential. It is not uncommon, as a method of grounding such fittings to pass the fitting through, say, the end cathode of the stack and to electrically connect the tubular fittings to this end cathode so that the tubular fitting is at the end cathode potential which is also the ground potential.

A drawback of this system is that electric current flows during the electrolysis not only via ionic carriers from an electrode of one polarity to an electrode of an opposite polarity through the electrolyte but also to a lesser extent through the feed and discharge fittings via the passages to ground. These currents are referred to as parasitic currents since they do not contribute to electrolysis and reduce the electrolytic efficiency of the apparatus.

To a certain extent the parasitic currents can also give rise to hydrogen at undesired locations, this parasitically produced hydrogen contaminating the oxygen produced.

It is known to protect high efficiency catalytically effective electrodes of electrolyzers when the apparatus is not in operation by applying a certain minimum potential (a so-called protective potential) to such an electrode, thereby increasing the electrode life.

Because of the presence of parasitic currents, a higher protective potential is necessary than would theoretically otherwise be required. This represents a further increase in losses due to parasitic currents.

In "Advanced Water Electrolysis and Catalyst Stability under Discontinuous Operation", Int. J. Hydrogen Energy, Vol. 15, No. 2, 105–114, 1990; Divisek, J; Mergel J; Schmitz, H., "Intermittently Operating Advanced Alkaline Water Electrolyser", Dechema-Monographie, Vol. 123, 65–76, VCH Verlagsgesellschaft 1991; J. Divisek, J. Mergel, H. Schmitz, it has already been proposed to provide tubes, ducts and connecting fittings of nonconductive materials.

However, all of these insulating techniques have been found to be very expensive and difficult to achieve, especially with conventional electrolysis blocks or stacks.

Flange connections to the cathodic end plate, in particular, have been found to be difficult to carry out in a retrofit operation and to be practically impossible with most nonconductive materials. The problem of parasitic currents has therefore remained.

OBJECTS OF THE INVENTION

It is, therefore, the principal object of the present invention to provide an electrolyzer which satisfies the requirements for conventional electrolyzers but yet has increased efficiency and reduced losses due to parasitic currents without any degradation of the mechanical properties of the unit and without significantly increased cost.

Another object of the invention is to provide an improved electrolyzer, especially for producing hydrogen and oxygen by electrolysis, which can generate oxygen with high purity and without parasitic contamination without materially increasing the cost of the electrolyzer.

Still another object of this invention is to provide an improved electrolyzer which is free from drawbacks of earlier electrolyzers.

SUMMARY OF THE INVENTION

These objects and others which will become apparent hereinafter are attained, in accordance with this invention in an electrolyzer having the following features, in addition to those which are standard for commercial electrolyzers of the type described, a passage for supplying the electrolyte or for discharging an electrolysis gas, the passage has a segment or fitting composed of metal, the metal passage portion or fitting is electrically grounded, in the interior of the metal fitting there is provided a tubular segment of electrically nonconductive material, the electrically nonconductive tube segment is hermetically sealed with an electrical insulation, and the electrical insulation separates the metallic portion of the passage or fitting electrically from a passage forming portion in the interior of the electrolysis block.

More particularly, the electrolyzer of the invention can comprise:

at least one cell having electrodes and a diaphragm between the electrodes for electrolyzing an electrolyte to produce at least one gas;

respective passages communicating with the cell for delivering the electrolyte and withdrawing the gas from the cell, at least one of the passages being formed with a tubular metallic fitting extending from the cell and a channel-forming member within the cell communicating with the metallic fitting through one of the electrodes;

a tube segment of electrically nonconductive material within the tubular metallic fitting; and an electrical insulation between the one of the electrodes and the tube segment.

With this electrolyzer having its tubular metal fitting surrounding the electrically nonconductive tube, e.g. of Teflon, any parasitic current must travel through the electrically nonconductive tube before it reaches a grounded metal member. The longer the nonconductive tube, the smaller is the parasitic current. The electrically nonconductive tube can be hermetically sealed to the metal wall of the tubular fitting although such a sealed relationship is not required. Indeed, the insulating tube can be spaced inwardly from the tubular fitting. The shape of the insulating tube or the tubular fitting can be optional (round, polygonal or another cross section). The electrical insulation electrically separates the metallic grounded fitting from the remainder of the passage-forming structure within the interior of the electrolysis block or stack. The electrical insulation can be, for example, an annular Teflon washer or other ring shaped member which is disposed between a cathodic end plate and an end portion of the passage forming member within the interior of the electrolysis block. The inner passage-forming member can be provided with the electrical insulation itself in the case in which it is not fabricated entirely of an electrically nonconductive material.

The electrically insulating tube is hermetically sealed with this electrical insulation. The term "hermetically sealed" as used here is intended to mean that electrolyte fed to the block can pass through the sealed junction and produced gases can pass through the sealed junction without leakage or leakage locations at which parasitic currents can form.

With the electrical insulation of the invention, any parasitic current which might flow through the passages within the electrolysis block cannot travel to ground directly at the end electrode but must travel significantly further through, say, another cell with its anode-diaphragm-cathode combination and thus can participate in electrolysis, or over a greatly lengthened path through the insulating tube to ground, thereby greatly suppressing the magnitude of such parasitic currents.

The longer the insulating tube, as has been noted, the greater the ohmic resistance which must be overcome by the parasitic current. (In this connection it may be noted that the specific electrical conductivity of the electrolyte or the product gas is comparatively small).

The greater the ohmic resistance, the lesser will be the proportion of the parasitic flowing current from the interior of the cell to ground.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
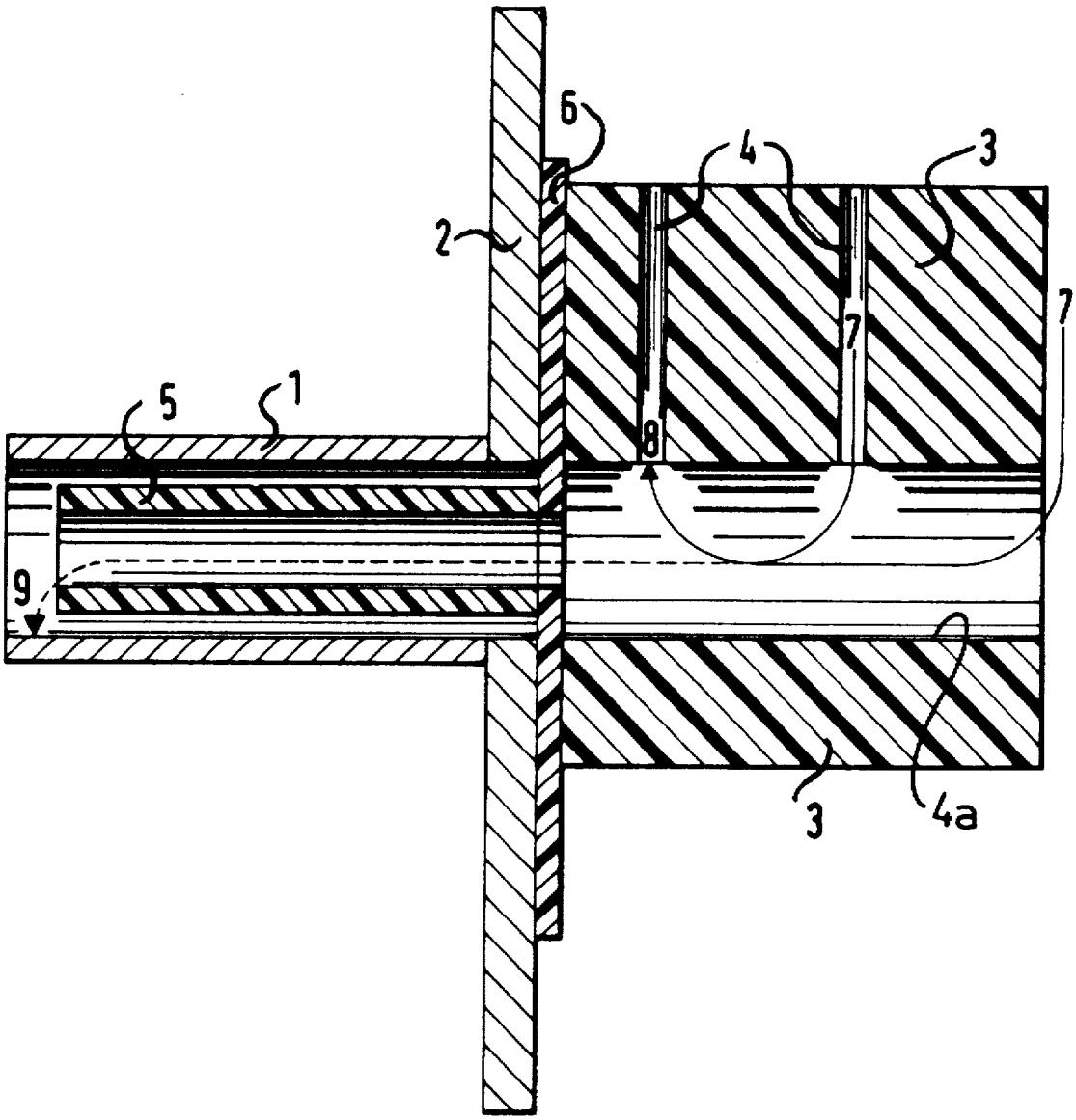
FIG. 1 is a cross sectional view of the portion of an electrolyzer illustrating the improvement of the invention.

FIG. 1 shows an embodiment of the invention in which the metal fitting 1, i.e. a metal pipe, is affixed to a cathodic end plate 2 of an electrolysis stack, block or pile as has been described. Through the fitting 2, electrolyte is fed into the electrolyzer stack or gas produced in the electrolyzer stack is discharged. Within the electrolyzer stack, a polysulfone body 3 forms the passages distributing the electrolyte to the analyte and catholyte chambers or removes the gas. For this purpose, the molded body 3 is provided with bores 4 which branch from a cylindrical passage **4*a* which ultimately communicates with the interior of the fitting 1. In other words, the molded body 3 with its bores 4 and its passage 4*a* serves as the connection between the passage formed by the fitting 1** and the electrolysis cells.

A tube 5 of polytetrafluoroethylene (Teflon) extends into the interior of the fitting 1 and is hermetically sealed to an annular polytetrafluoroethylene washer 6 forming the electrical insulation. The Teflon washer 6 is disposed between the cathodic end plate 2 and the molded body 3 adjoining this end plate.

The current 7 arising from the electrolysis cell delimited by the cathode end plate 2 can travel along the path 8 back to the cell to contribute to the electrolysis or can flow in a parasitic path as represented by the arrow 9 along the Teflon tube 5 to the grounded metal wall of the fitting 1. Here the grounding provides the same cathodic potential at the fitting 1 as is at the end cathode 2. The longer the Teflon tube 5 the longer is the parasitic path 9 and the greater the ohmic resistance which must be overcome by the flow of this parasitic current to reach a grounded surface. The greater the ohmic resistance, the less is the proportion of the parasitic current to the total current 7. The greater, of course, will then be the proportion of the current which is returned to the electrolysis process.

The use of a ring-shaped electrical insulation 6 is preferred because it has the advantage that the system of FIG. 1 can be applied to commercially available apparatus in a retrofit.

Figure 2:
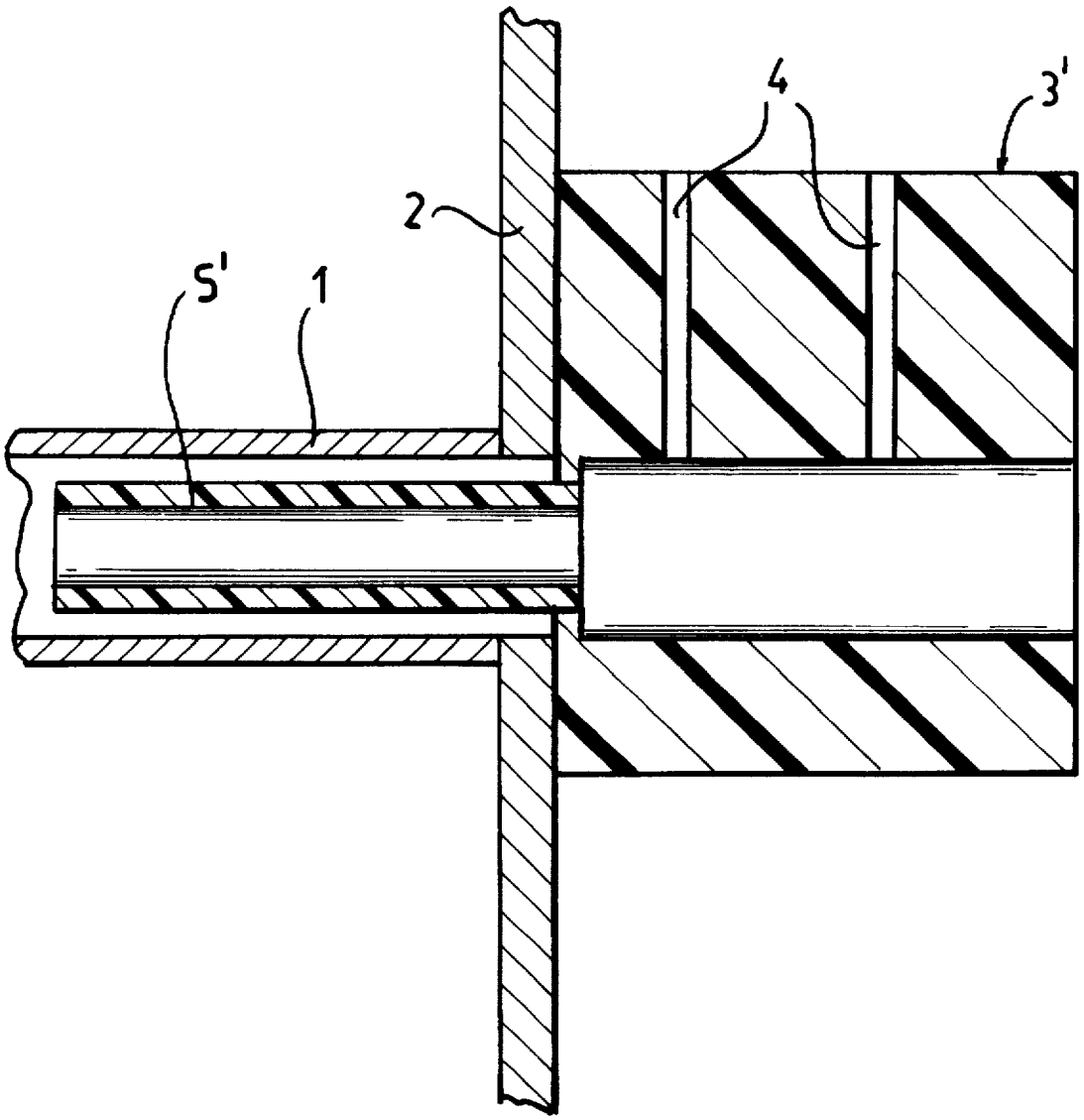
FIG. 2 is a view similar to FIG. 1 of another embodiment thereof.

However, as shown in FIG. 2, the electrically insulating tube 5' can be hermetically sealed directly to the molded body 3' which is also composed of electrically insulating material.

Figure 3:
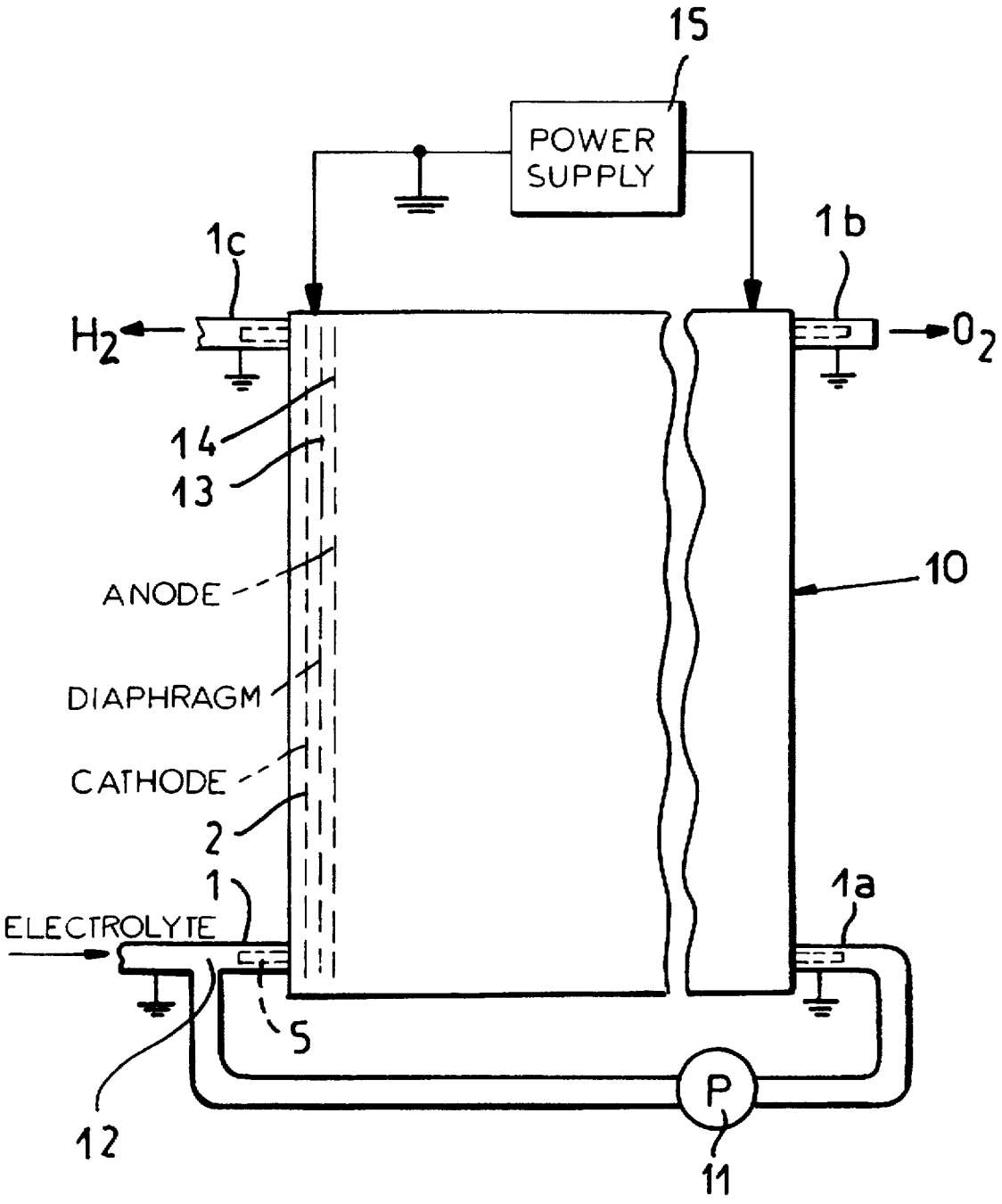
FIG. 3 is an elevational view in highly diagrammatic form of an electrolyzer according to the invention utilizing the antiparasitic elements of FIG. 1 or FIG. 2 at both the electrolyte inlet or outlet and the gas outlet fittings.

The principle of the invention is applicable to the tubular fitting 1 at which electrolyte is fed to the electrolysis cell block 10 shown in as well as to the metal tubular fittings **1*a* which carries electrolyte on a recycling path via the pump 11** and a Tee 12 back to the inlet fitting 1. The fittings of FIGS. 1 and 2 can also represent the gas discharge fittings 1*b* and 1*c* for the oxygen and the hydrogen, which also are provided with tubes 5 or 5' as have been described. Finally, the electrolysis block 10 is shown to comprise a plurality of cells, one of which can have the end cathode 2, the diaphragm 13 and the anode 14 diagrammatically shown in FIG. 3 and the power supply for the electrolysis cell has been shown at 15 and has its cathodic potential grounded as are each of the tubular fittings as shown.

We claim:

1. An electrolyzer comprising:

at least one cell having electrodes and a diaphragm between said electrodes for electrolyzing an electrolyte to produce at least one gas;

respective passages communicating with said cell for delivering said electrolyte and withdrawing said gas from said cell, at least one of said passages being formed with a tubular metallic fitting extending from the cell and a channel-forming member within said cell communicating with said metallic fitting through one of said electrodes through respective flow channels;

a tube segment of electrically nonconductive material within said tubular metallic fitting; and an electrical insulation between said one of flow channels and separating said flow channels from said tube segment, said tube segment being sealed to said electrical insulation to prevent fluid leakage therebetween.

2. The electrolyzer defined in claim 1 wherein said metallic fitting and said tube segment form said passage communicating with said cell for delivering said electrolyte.

3. The electrolyzer defined in claim 1 wherein said metallic fitting and said tube segment form said passage communicating with said cell for withdrawing said gas from said cell.

4. The electrolyzer defined in claim 1 wherein said channel-forming member is composed of an electrically insulating material and said tube segment is hermetically sealed to said channel-forming member.

5. The electrolyzer defined in claim 1 wherein said metallic fitting is electrically grounded.

6. An electrolyzer comprising:

at least one cell having electrodes and a diaphragm between said electrodes for electrolyzing an electrolyte to produce at least one gas;

respective passages communicating with said cell for delivering said electrolyte and withdrawing said gas from said cell, at least one of said passages being formed with a tubular metallic fitting extending from the cell and a channel-forming member within said cell communicating with said metallic fitting through one of said electrodes through respective flow channels;

a tube segment of electrically nonconductive material within said tubular metallic fitting; and an electrical insulation between said one of flow channels and separating said flow channels from said tube segment, said tube segment being sealed to said electrical insulation to prevent fluid leakage therebetween, said electrical insulation being a ring lying against said one of said electrodes and said tube segment being hermetically sealed to said ring.

7. An electrolyzer comprising:

at least one cell having electrodes and a diaphragm between said electrodes for electrolyzing an electrolyte to produce at least one gas;

respective passages communicating with said cell for delivering said electrolyte and withdrawing said gas from said cell, at least one of said passages being formed with a tubular metallic fitting extending from the cell and a channel-forming member within said cell communicating with said metallic fitting through one of said electrodes through respective flow channels;

a tube segment of electrically nonconductive material within said tubular metallic fitting; and an electrical insulation between said one of flow channels and separating said flow channels from said tube segment, said tube segment being sealed to said electrical insulation to prevent fluid leakage therebetween, said electrical insulation being a ring lying against said one of said electrodes and said tube segment being hermetically sealed to said ring.

8. The electrolyzer defined in claim 7 wherein said metallic fitting and said tube segment form said passage communicating with said cell for delivering said electrolyte.

9. The electrolyzer defined in claim 7 wherein said metallic fitting and said tube segment form said passage communicating with said cell for withdrawing said gas from said cell.

10. The electrolyzer defined in claim 7 wherein said tube segment is spaced from said fitting.

11. An electrolyzer comprising:

at least one cell having electrodes and a diaphragm between said electrodes for electrolyzing an electrolyte to produce at least one gas;

respective passages communicating with said cell for delivering said electrolyte and withdrawing said gas from said cell, at least one of said passages being formed with a tubular metallic fitting extending from the cell and a channel-forming member within said cell communicating with said metallic fitting through one of said electrodes through respective flow channels;

a tube segment of electrically nonconductive material within said tubular metallic fitting; and an electrical insulation between said one of flow channels and separating said flow channels from said tube segment, said tube segment being sealed to said electrical insulation to prevent fluid leakage therebetween, said metallic fitting being electrically grounded, said channel-forming member being composed of an electrically insulating material and said tube segment being hermetically sealed to said channel-forming member.

12. The electrolyzer defined in claim 11 wherein said metallic fitting and said tube segment form said passage communicating with said cell for delivering said electrolyte.

13. The electrolyzer defined in claim 11 wherein said metallic fitting and said tube segment form said passage communicating with said cell for withdrawing said gas from said cell.

14. The electrolyzer defined in claim 11 wherein said tube segment is spaced from said fitting.

* * * * *